US006722587B2

(12) United States Patent
Hanano

(10) Patent No.: US 6,722,587 B2
(45) Date of Patent: Apr. 20, 2004

(54) SPRAY SYSTEM

(75) Inventor: Takashi Hanano, Kobe (JP)

(73) Assignee: Hanano Corporation, Kobe (JP)

( * ) Notice: Subject to any disclaimer, the term of this patent is extended or adjusted under 35 U.S.C. 154(b) by 161 days.

(21) Appl. No.: 10/075,275

(22) Filed: Feb. 15, 2002

(65) Prior Publication Data

US 2003/0111561 A1 Jun. 19, 2003

(30) Foreign Application Priority Data

Dec. 19, 2001 (JP) ..... 2001-385388

(51) Int. Cl.[7] ..... A62C 2/08

(52) U.S. Cl. ..... 239/548; 239/553.5; 239/559; 239/565; 239/590.5; 118/306; 425/96

(58) Field of Search ..... 239/548, 553, 239/553.5, 554, 555, 557, 559, 565, 590.5, 596, 536, 267, 268, DIG. 1; 118/306, 313, 315, 316, 317; 164/149, 267; 425/96, 100, 103, 107

(56) References Cited

U.S. PATENT DOCUMENTS 4,605,170 A * 8/1986 Thurner ..... 425/96
4,739,933 A * 4/1988 Hanano ..... 239/560
5,916,367 A * 6/1999 Wollin ..... 118/306

FOREIGN PATENT DOCUMENTS

JP 06-210425 * 8/1994
JP 08-323457 * 12/1996

* cited by examiner

*Primary Examiner*—Dinh Q. Nguyen
(74) *Attorney, Agent, or Firm*—Crowell & Moring LLP

(57) ABSTRACT

A spray system has a base plate, a support member, a first cylinder mechanism and a second cylinder mechanism, a first slide tube and a second slide tube, a first board portion and a second board portion, a first holding bar, and a second holding bar. Each board portion is so constructed that a nozzle cassette is detachably fitted to a board base plate, the nozzle cassette is equipped with a number of spray nozzles, the first cylinder mechanism is so constructed that the first board portion can be moved relative to the support member, and the second cylinder mechanism is so constructed that the second board portion can be moved relative to the support member.

6 Claims, 15 Drawing Sheets

SPRAY SYSTEM

BACKGROUND OF THE INVENTION

This invention relates to a spray system which sprays mold release agent etc. onto inside surfaces of opened metal molds for a casting machine.

In a conventional spray system, two board portions equipped with spray nozzles for spraying the mold release agent etc. have been unmovable. Replacement of the board portion has been done by detaching and attaching the entire board portion. In addition, a surface of the board portion facing on the inside surface of the metal mold has been flat, and the spray nozzles have been installed on the flat surface.

In the conventional spray system having the foregoing structure has presented the following problems.

(1) Because of the two unmovable board portions, there existed points in the inside surfaces of metal molds to which the mold release agent etc. could not be sprayed so that defective die-cast products would be produced, in case where the inside surface of a metal mold to be sprayed included deep grooved configurations. For this reason, the spray system having such a structure that one-side board portion can be moved is proposed in Publication No. JP-5-329608. According to this system, the occurrence of defective die-cast products can be reduced as compared with the conventional spray system. In the field of die-cast technology, however, it is desired to further reduce the occurrence of defective die-cast products.

(2) Since the entire board portion is heavy, a detaching/attaching operation of the entire board portion has been difficult and dangerous.

(3) Since the spray nozzles are installed on the flat surface of the board portion, the nozzle length has been set to 200 to 500 mm in case where the inside surface of metal mold has included complicated configurations. In case of a long nozzle length, however, it has been difficult to spray the mold release agent etc. onto a spray point accurately because the nozzle is easily affected by vibration etc. of the board portion. For this reason, defective die-cast products would be produced.

SUMMARY OF THE INVENTION

An object of this invention is to provide a spray system which can spray the mold release agent etc. onto a spray point of the inside surface of the metal mold accurately and can further reduce an occurrence of defective die-cast products.

A first embodiment is a spray system for spraying a mold release agent etc. onto inside surfaces of opened metal molds for a die casting machine; having a base plate to which a supply device for distributing and supplying the mold release agent etc. is mounted, a support member fixed to the base plate, a first cylinder mechanism and a second cylinder mechanism both fixed to the support member, a first slide tube and a second slide tube both fixed to the support member, a first board portion and a second board portion disposed oppositely on both sides of the support member and equipped with spray nozzles for spraying the mold release agent etc., a first holding bar one end of which is fixed to the first board portion and the other end side of which slidably pierces and extends through the support member, and a second holding bar one end of which is fixed to the second board portion and the other end of which slidably pierces and extends through the support member; in which the first slide tube is freely expandable between the support member and the first board portion and connects a supply outlet of the supply device and a passage inlet of the first board portion, the second slide tube is freely expandable between the support member and the second board portion and connects the supply outlet of the supply device and a passage inlet of the second board portion, each board portion is so constructed that a nozzle cassette is detachably fitted to a board base plate, the nozzle cassette is equipped with a large number of spray nozzles, and the spray nozzle is connected to the passage inlet of the board portion, each cylinder mechanism is composed of a cylinder body fixed to the support member and a rod expanding from and retracting in the cylinder body, the first cylinder mechanism has such a construction as to move the first board portion relative to the support member by expanding and retracting the rod in parallel with the first holding bar, and the second cylinder mechanism has such a construction as to move the second board portion relative to the support member by expanding and retracting the rod in parallel with the second holding bar.

According to the first embodiment, the first board portion and the second board portion can be moved so that the first board portion can be put near to the inside surface of the fixed metal mold and the second board portion can be put near to the inside surface of the movable metal mold. Therefore, the mold release agent etc. can be sprayed onto the inside surfaces of both metal molds accurately and securely. Consequently, the occurrence of defective die-cast products can be prevented.

Since each board portion is so constructed that the nozzle cassette is detachably fitted to the board base plate, each board portion can be replaced only by detaching and attaching the nozzle cassette. Therefore, the replacement work of each board portion can be done easily and safely.

A second embodiment is a spray system under a not-moving state of the first board portion and the second board portion; in which the other end of the first holding bar also slidably pierces and extends through the second board portion, the first slide tube is composed of an external tube and an internal tube expandable from the external tube, the tip end of the internal tube connects to the first board portion, and the external tube pierces and extends through the second board portion.

According to the invention of the second embodiment, the moving distance of the first board portion can be made large. Therefore, the spray nozzle can be put nearer to the inside surface of the fixed metal mold so that more accurate spraying becomes possible.

A third embodiment is a spray system under a not-moving state of the first board portion and the second board portion; in which the other end of the second holding bar also slidably pierces and extends through the first board portion, the second slide tube is composed of an external tube and an internal tube expandable from the external tube, the tip end of the internal tube connects to the second board portion, and the external tube pierces and extends through the first board portion.

According to the third embodiment, the moving distance of the second board portion can be made large. Therefore, the spray nozzle can be put nearer to the inside surface of the movable metal mold so that more accurate spraying becomes possible.

A fourth embodiment is a spray system in which the nozzle cassette has concave and convex configurations corresponding to concave and convex configurations on the inside surfaces of the metal mold to be sprayed, and includes a number of spray nozzles on surfaces of the concave/convex configurations.

According to the fourth embodiment, the mold release agent etc. can be sprayed securely even onto side faces of the concave and convex configurations of the inside surfaces of both metal molds. Therefore, the mold release agent etc. can be sprayed thoroughly onto the inside surfaces of both metal molds. Consequently, an occurrence of defective die-cast products including seizure etc. can be prevented more securely.

A fifth embodiment is a spray system in which each board portion is provided with a shock absorber for moderating a shock occurring when the board portion strikes against the metal mold.

According to the fifth embodiment, the shock occurring when each board portion strikes against the metal mold can be moderated and a breakage of the spray nozzle due to the striking can be prevented.

A sixth embodiment is a spray system in which two base plates stand at right angles to the board portion and are disposed in such a way as to face each other, the supply device is fixed to the one-side base plate, and the two base plates are supported by diagonally connected turnbuckles.

According to the sixth embodiment, the two base plates can be firmly held perpendicular to, and facing, each other.

DETAILED DESCRIPTION OF THE PREFERRED EMBODIMENTS

Figure 1:
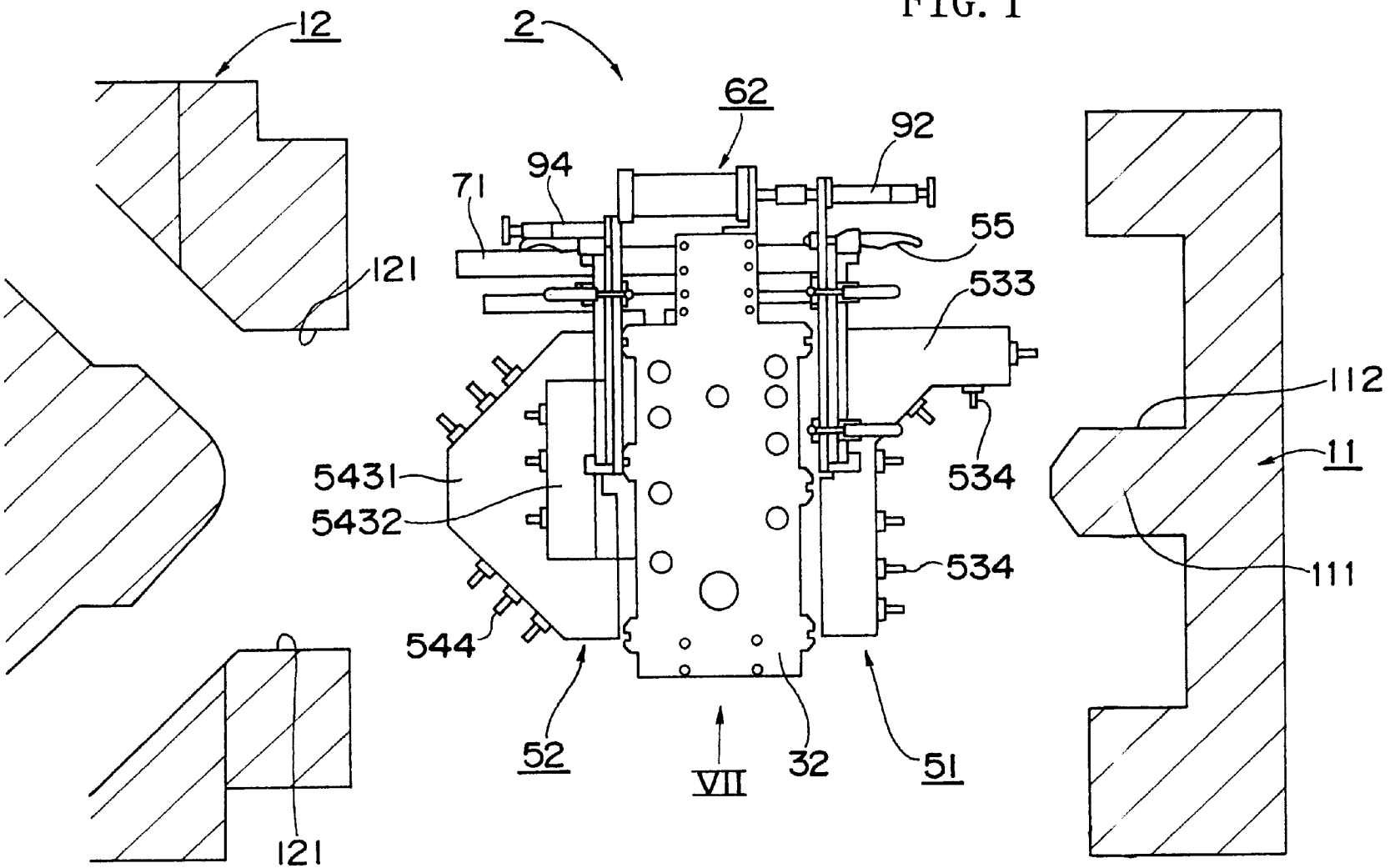
FIG. 1 is a partially sectional front view showing a state where the spray system of this invention is disposed between both metal molds opened in lateral direction of a die casting machine.

FIG. 1 is the partially sectional front view showing the state where the spray system 2 of this invention is disposed between a fixed metal mold 11 and a movable metal mold 12 opened in the lateral direction of the die casting machine. The spray system 2 of FIG. 1 is under the not-working state.

Figure 2:
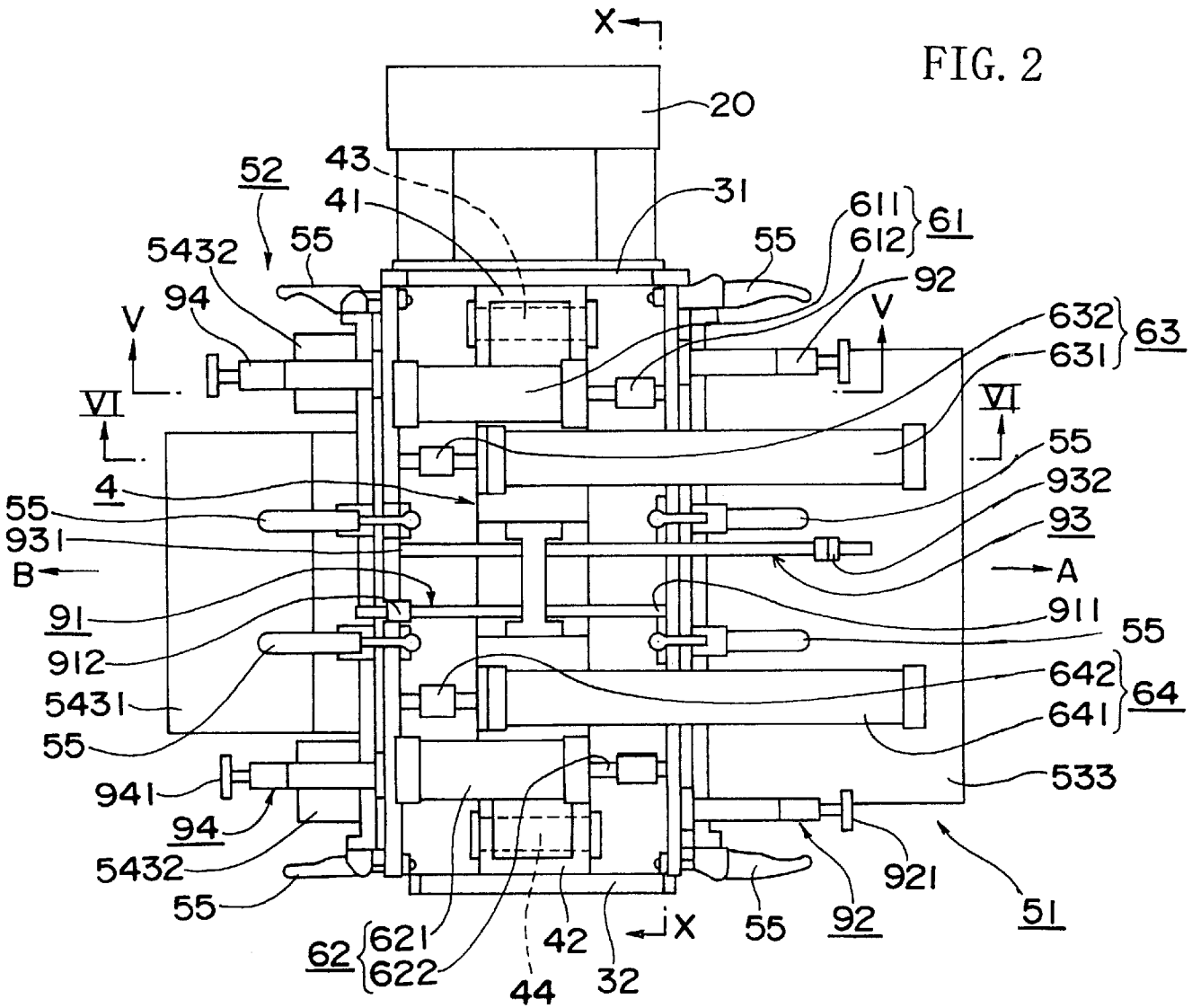
FIG. 2 is a plan view of the spray system of FIG. 1.
Figure 3:
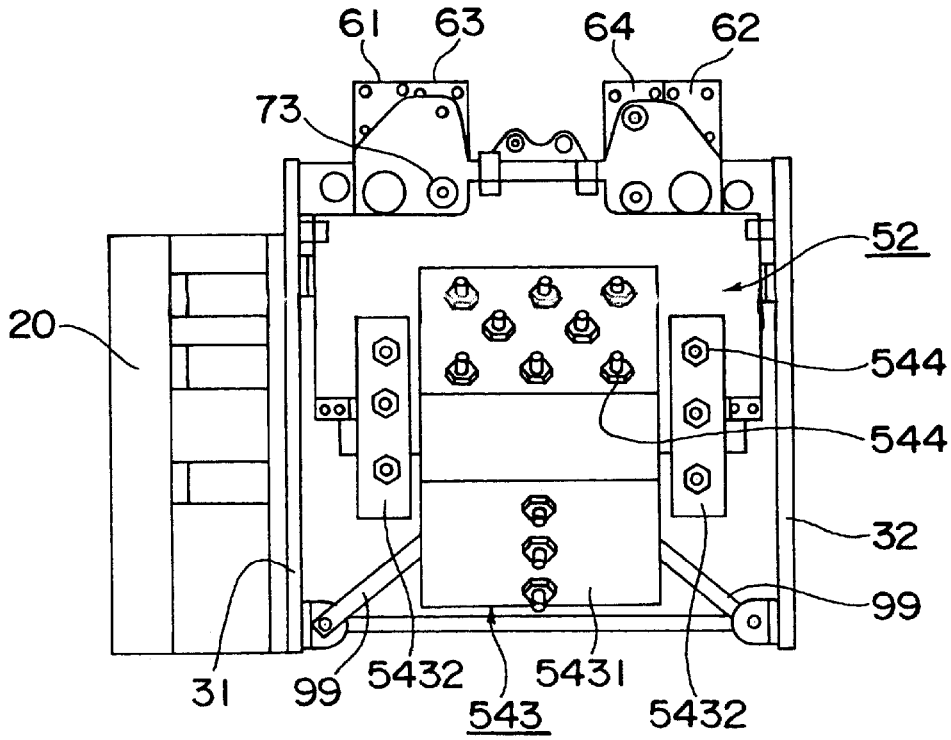
FIG. 3 is a left side view of the spray system of FIG. 1.
Figure 4:
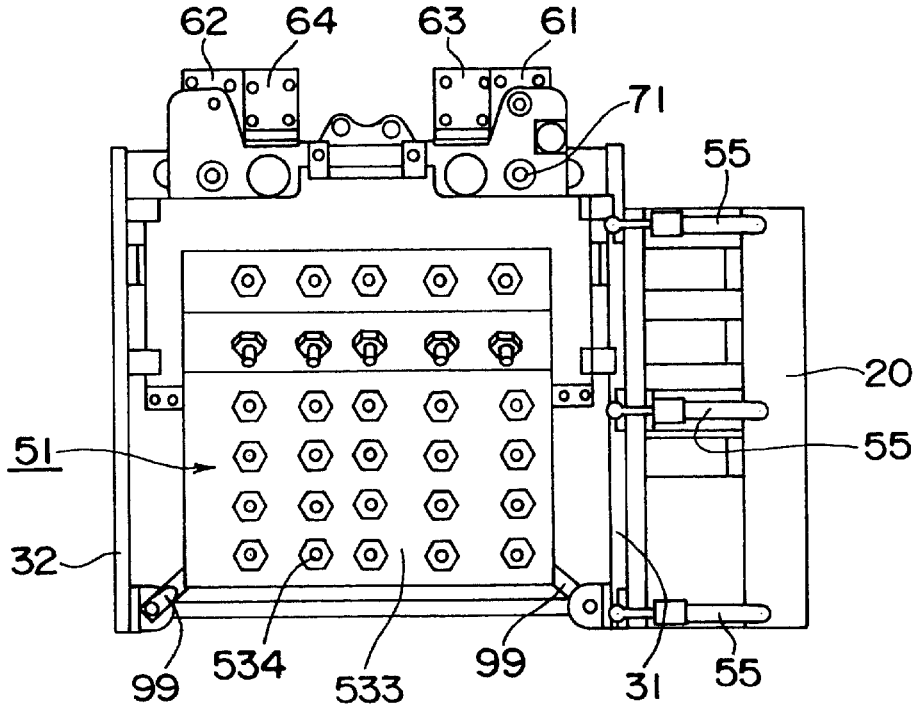
FIG. 4 is a right side view of the spray system of FIG. 1.

FIG. 2 is the plan view of the spray system 2 of FIG. 1, FIG. 3 is the left side view of the spray system 2 of FIG. 1, and FIG. 4 is the right side view of the spray system 2 of FIG. 1. The spray system 2 is equipped with two base plates 31 & 32 disposed perpendicular to and facing each other, as specially illustrated in FIG. 2. A supply device 20 for distributing and supplying a mold release agent etc. is fixed to the one-side base plate 31. The mold release agent etc. mean a mold release agent, a seizure inhibitor and cool water etc.

The supply device 20 is equipped with an atomizer device and a distribution manifold (both not shown). In this instance, a mold release agent, a seizure inhibitor, and cool water are used for the mold release agent etc. The atomizer device is equipped with a first atomizer which produces mold release agent mixture by mixing the mold release agent with air, a second atomizer which produces seizure inhibitor mixture by mixing the seizure inhibitor with air, and a third atomizer which produces cool water mixture by mixing cool water with air. The distribution manifold is equipped with a first chamber connecting to the first atomizer, a second chamber connecting to the second atomizer, a third chamber connecting to the third atomizer, and an air blow chamber connecting to an air supply source (not shown).

A support member 4 (FIG. 2) is placed at right angles to the base plates 31 & 32 on an upper part of and between the base plates 31 & 32. The support member 4 is a square pole which is fixed by pins 43 & 44 to flanges 41 & 42 fixed to the base plates 31 & 32.

A first board portion 51 and a second board portion 52 are oppositely disposed on both sides of the support member 4. Both board portions 51 & 52 are located in parallel with the support member 4.

The first cylinder mechanism and the second cylinder mechanism are fixed onto an upper face of the support member 4. Two cylinder mechanisms 61 & 62 are installed for serving as the first cylinder mechanism, and two cylinder mechanisms 63 & 64 are installed for serving as the second cylinder mechanism. The two cylinder mechanisms 61 & 62 are longitudinally positioned at both sides of the support member 4, and the two cylinder mechanisms 63 & 64 are longitudinally positioned at a central part of the support member 4.

Figure 5:
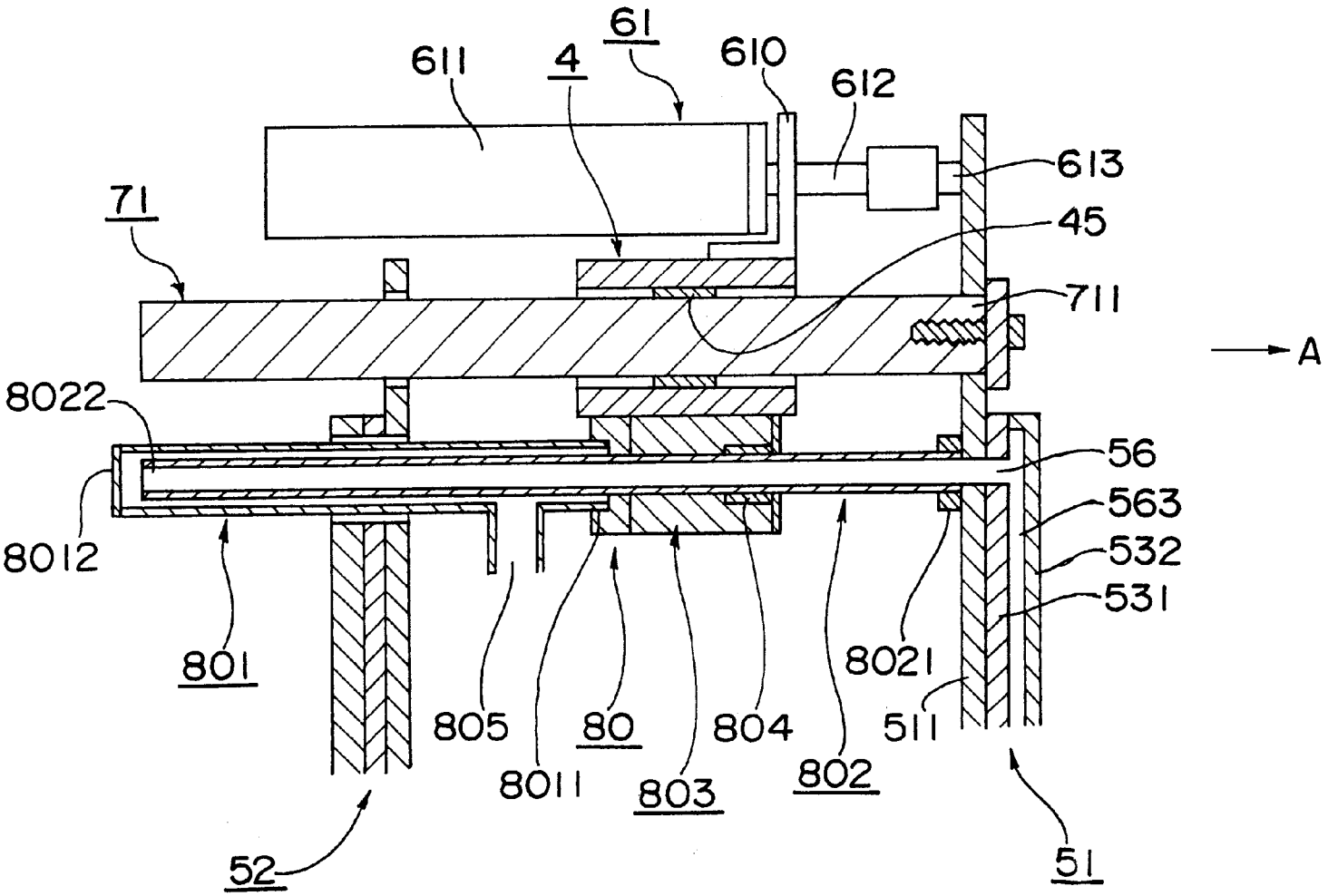
FIG. 5 is a sectional partial view taken on a line V—V of FIG. 2.

FIG. 5 is a sectional partial view taken on the line V—V of FIG. 2, i.e. a vertical sectional view of a part to which the cylinder mechanism 61 forming the first cylinder mechanism is fixed. As shown in FIG. 5, the cylinder mechanism 61 is composed of a cylinder body 611 and a rod 612. The rod 612 is expandable from the cylinder body 611. The cylinder body 611 is fixed to the support member 4 through a flange 610. The rod 612 is expandable at right angles to and horizontally with the support member 4. A tip end 613 of the rod 612 is fixed to the first board portion 51.

A holding bar 71 is installed at a lower part of the cylinder mechanism 61 at right angles to and horizontally with the support member 4. One end 711 of the holding bar 71 is fixed to the first board portion 51, and the other end side slidably pierces the support member 4 through a bearing 45 etc. and further slidably pierces and extends through the second board portion 52, too.

The cylinder member 62 also has the same structure as the cylinder mechanism 61, and is installed in the same way as the cylinder mechanism 61. Namely, the cylinder mechanism 62 is composed of a cylinder body 621 and a rod 622. In addition, a holding bar having the same structure as the holding bar 71 is installed at a lower part of the cylinder mechanism 62 in the same way as the holding bar 71. These holding bars 71 etc. are installed for serving as a first holding bar.

Figure 6:
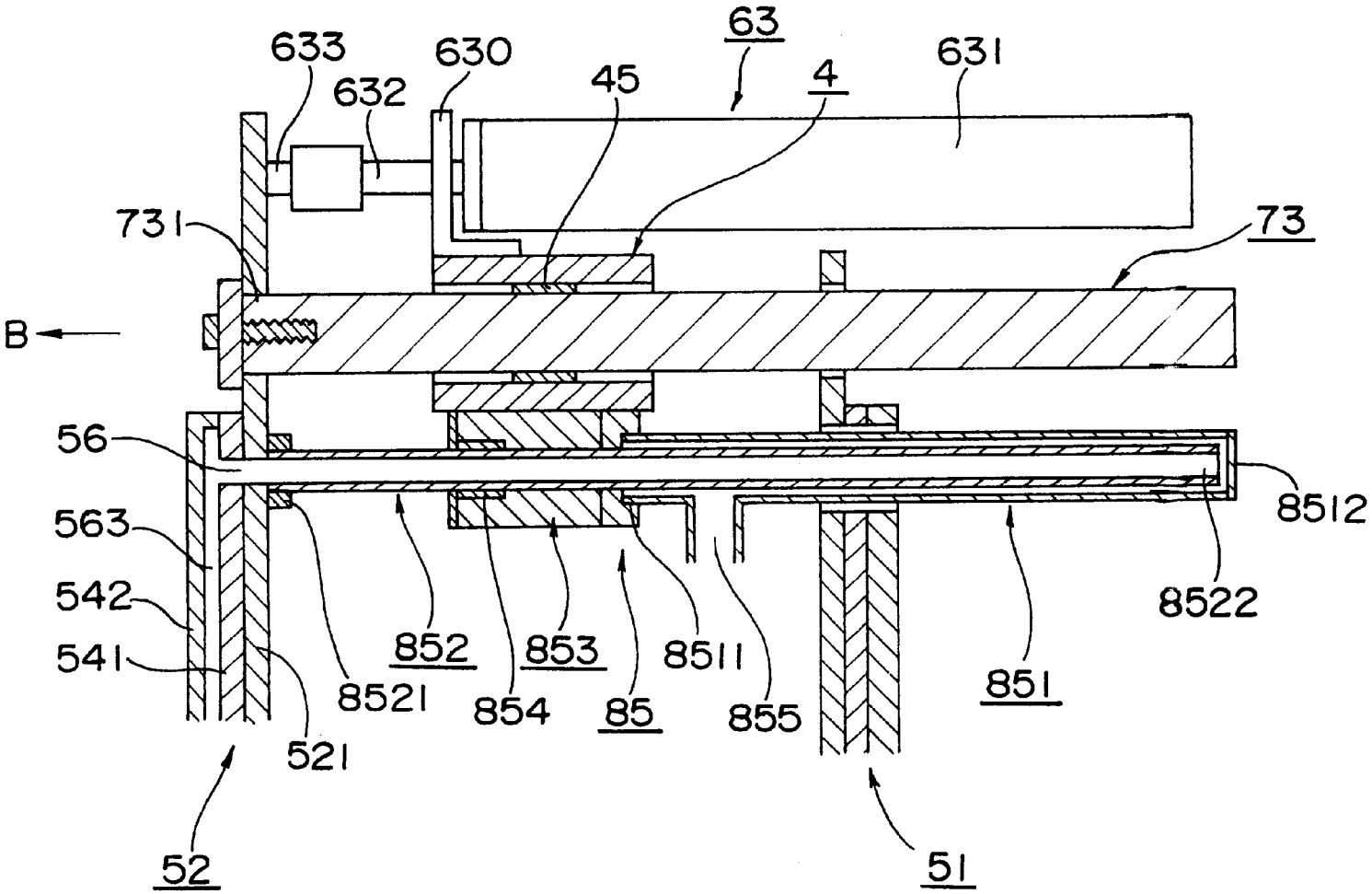
FIG. 6 is a sectional partial view taken on a line VI—VI of FIG. 2.

FIG. 6 is a sectional partial view taken on the line VI—VI of FIG. 2, i.e. a vertical sectional view of a part to which the cylinder mechanism 63 for serving as the second cylinder mechanism is fixed. As shown in FIG. 6, the cylinder mechanism 63 has the same structure as the cylinder mechanism 61 but its installed position is reversed. The cylinder mechanism 63 is composed of a cylinder body 631 and a rod 632. The rod 632 is expandable from the cylinder body 631. The cylinder body 631 is fixed to the support member 4 through a flange 630. The rod 632 is expandable at right angle to and in horizontal with the support member 4. A tip end 633 of the rod 632 is fixed to the second board portion 52.

A holding bar 73 is installed at a lower part of the cylinder mechanism 63 at right angles to and horizontally with the support member 4. One end 731 of the holding bar 73 is fixed to the second board portion 52, and the other end side slidably pierces the support member 4 through a bearing 45 etc. and further slidably pierces and extends through the first board portion 51, too.

The cylinder mechanism 64 also has the same structure as the cylinder mechanism 63, and is installed in the same way as the cylinder mechanism 63. Namely, the cylinder mechanism 64 is composed of a cylinder body 641 and a rod 642. In addition, a holding bar having the same structure as the holding bar 73 is installed at a lower part of the cylinder mechanism 64 in the same way as the holding bar 73. These holding bars 73 etc. are installed for serving as a second holding bar.

Figure 7:
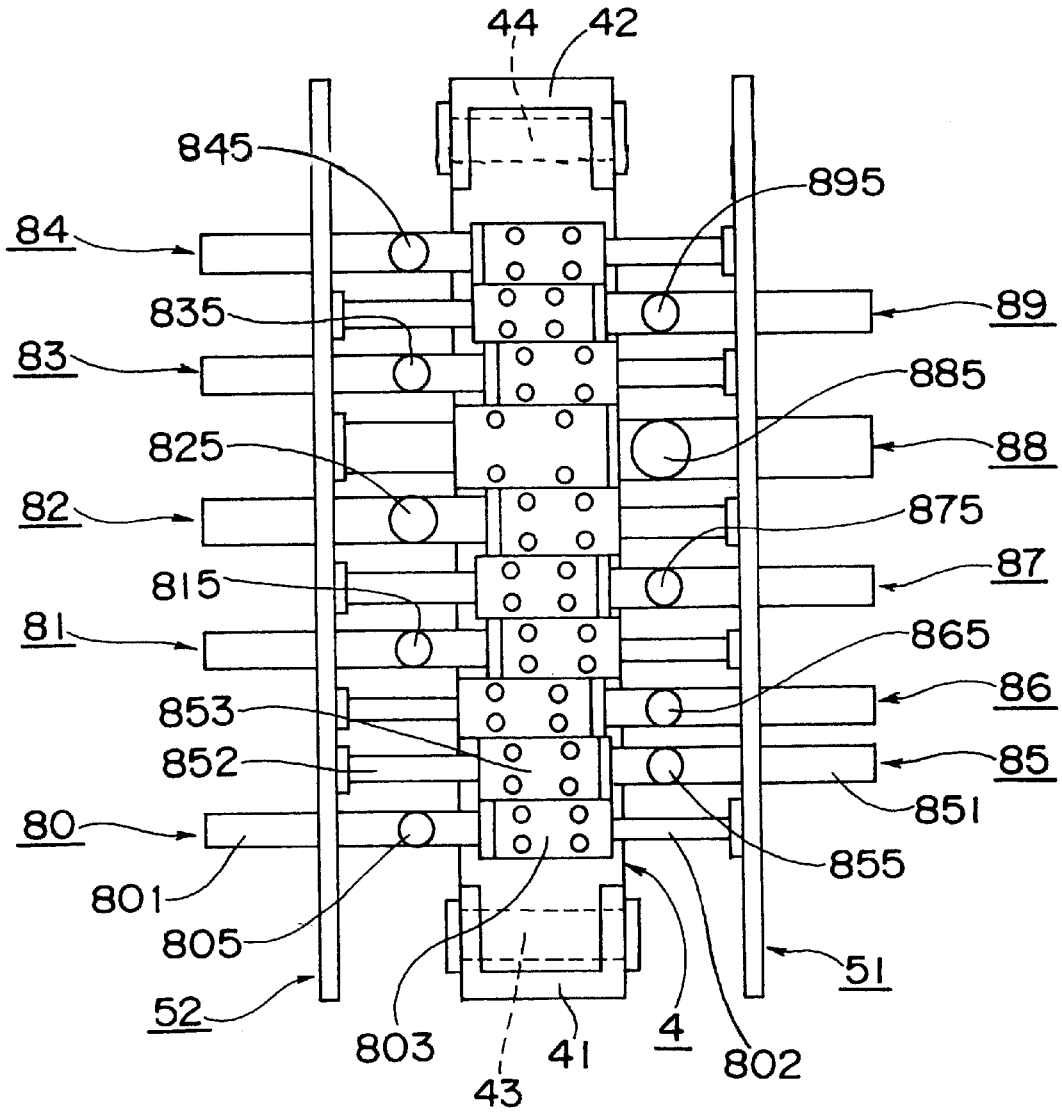
FIG. 7 is a partial view taken in the direction of VII of the spray system of FIG. 1.

FIG. 7 is a view of the support member 4 seen from below, i.e. a partial view of the spray system 2 viewed in the direction of VII of FIG. 1. As shown in FIG. 7, the first slide tube and the second slide tube are fixed to a lower face of the support member 4. Five slide tubes 80, 81, 82, 83 & 84 are installed for serving as the first slide tube, and five slide tubes 85, 86, 87, 88 & 89 are installed for serving as the second slide tube. These slide tubes have a one-stepped structure including only one stepped portion for sliding the tube, which is a well-known structure.

As shown in FIG. 5, the slide tube 80 forming the first slide tube is composed of an external tube 801, an internal tube 802 and a joint 803. One end 8021 of the internal tube 802 is fixed to the first board portion 51, and the other end side of it slidably pierces through the joint 803 to be inserted deeply into the external tube 801. The joint 803 is positioned at stepped portions between the external tube 801 and the internal tube 802. The internal tube 802 slidably pierces the joint 803 through an oil-retaining bearing 804 etc. The other end 8022 of the internal tube 802 is opened. One end 8011 of the external tube 801 is fixed to and blocked by the joint 803, and the other end side of it slidably pierces and extends through the second board portion 52. The other end 8012 is blocked. A clearance which enables the mixture of such as the mold release agent etc. to pass through, is secured between an inner surface of the external tube 801 and an outer surface of the internal tube 802. A space is secured also between the other end 8022 of the internal tube 802 and the other end 8012 of the external tube 801. A supply port 805 is opened downward mid way of the external tube 801. The slide tube 80 is fixed to a lower face of the support member 4 by the joint 803.

The slide tubes 81, 82, 83 & 84 also have the same structure as that of the slide tube 80 and are installed in the same way as the slide tube 80. In FIG. 7; 815, 825, 835 & 845 are supply ports for the slide tubes 81, 82, 83 & 84, respectively.

The slide tube 85 forming the second slide tube has the same structure as the slide tube 80 as illustrated in FIG. 6, however, it is installed at a position opposite that of the slide tube 80. The slide tube 85 is composed of an external tube 851, and internal tube 852 and a joint 853. One end 8521 of the internal tube 852 is fixed to the second board portion 52, and the other end of it slidably pierces through the joint 853 to be inserted deeply into the external tube 851. The joint 853 is positioned at stepped portions between the external tube 851 and the internal tube 852. The internal tube 852 slidably pierces the joint 853 through an oil-retaining bearing 854 etc. The other end 8522 of the internal tube 852 is opened. One end 8511 of the external tube 851 is fixed to and blocked by the joint 853, and the other end of it slidably pierces and extends through the first board portion 51. The other end 8512 is blocked. A clearance which enables a mixture of such as the mold release agent etc. to pass through, is secured between an inner surface of the external tube 851 and an outer surface of the internal tube 852. A space is secured also between the other end 8522 of the internal tube 852 and the other end 8512 of the external tube 851. A supply port 855 is opened downward mid way of the external tube 851. The slide tube 85 is fixed to a lower face of the support member 4 by the joint 853.

The slide tube 86, 87, 88 & 89 also have the same structure as that of the slide tube 85 and are installed in the same way as the slide tube 85. In FIG. 7; 865, 875, 885 & 895 are supply ports for the slide tubes 86, 87, 88 & 89, respectively.

As the result, the first board portion 51 is supported to the support member 4 by means of the first cylinder mechanism, the first holding bar and the first slide tube; and the second board portion 52 is supported to the support member 4 by means of the second cylinder mechanism, the second holding bar and the second slide tube.

Figure 8:
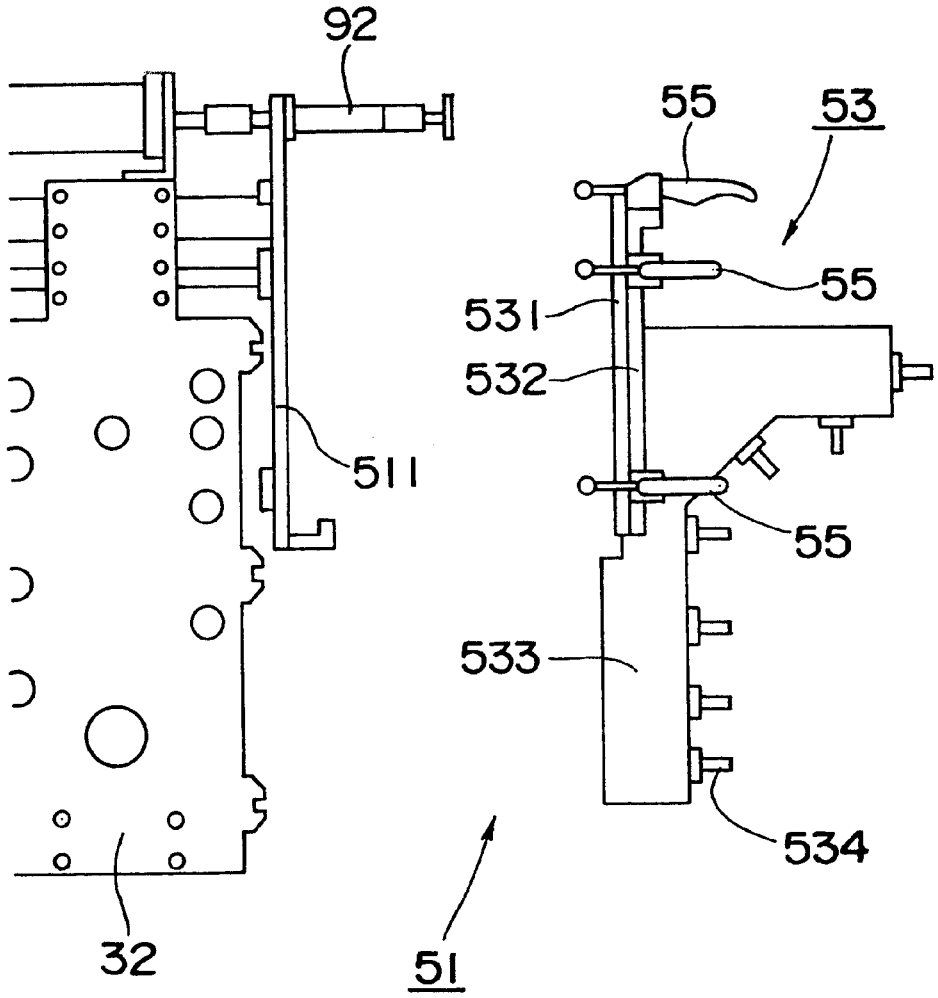
FIG. 8 is an exploded side view of the first board portion.

The first board portion 51 is so constructed that the nozzle cassette 53 is detachably fitted to the board base plate 511 as shown in FIG. 8. Detaching and attaching operations are done by clamp mechanisms 55. Here, six clamp mechanisms 55 in total are installed: two at the upper part of the nozzle cassette 53, two at one-side part of it, and two at the other-side part of it. The clamp device as described in Japanese Patent No. 3,055,884 obtained by the applicant of this invention is used for the clamp mechanism 55.

Figure 9:
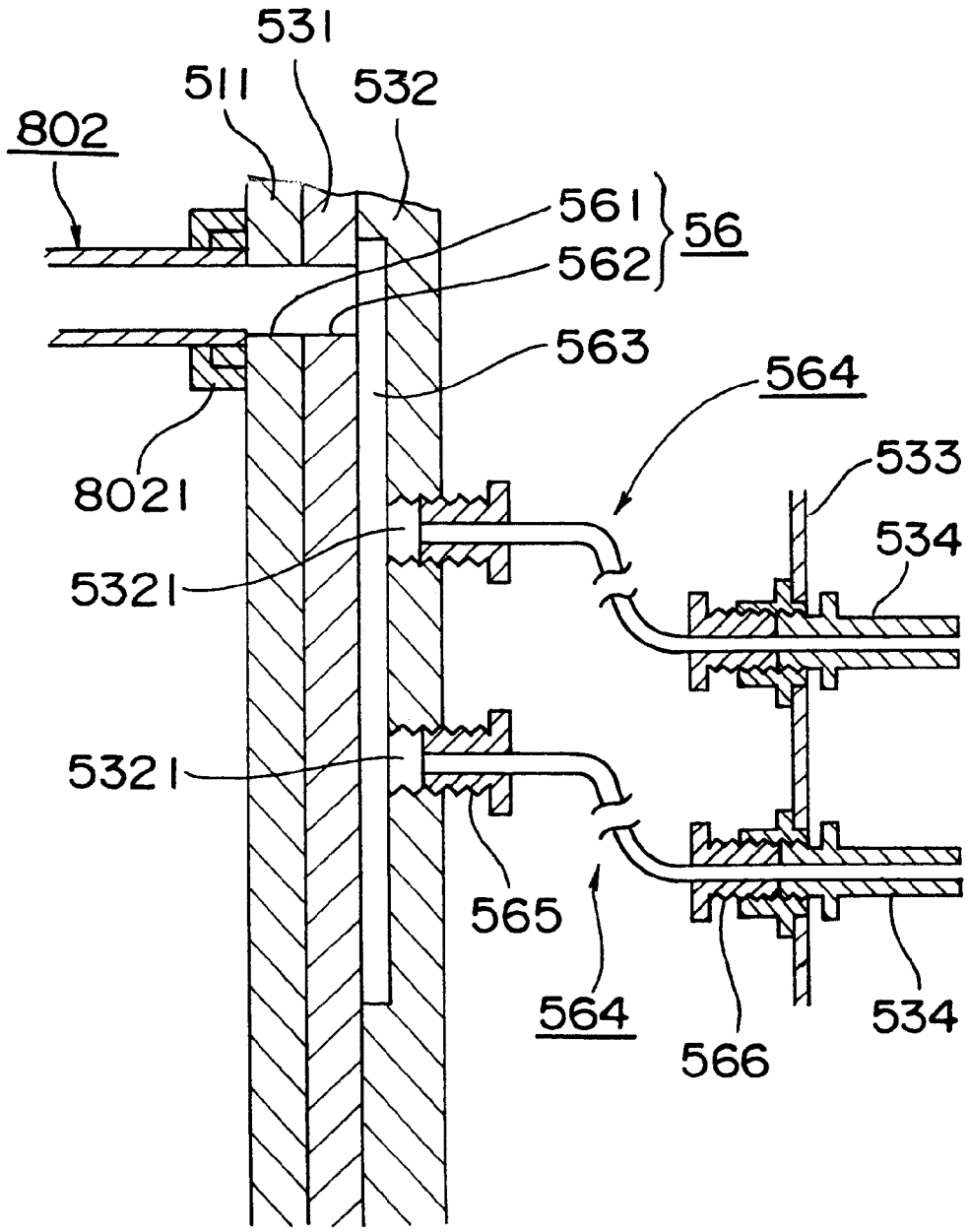
FIG. 9 is an enlarged partially sectional schematic view of the nozzle cassette.

The nozzle cassette 53 is composed of a cassette first base plate 531, a cassette second base plate 532, a hood 533 and a large number of spray nozzles 534. As shown in FIG. 9 forming an enlarged partially sectional schematic view, the board base plate 511 and the first base plate 531 have through holes 561 & 562 forming a passage inlet 56 connecting to one end 8021 of the internal tube 802 of the slide tube 80. A passage 563 connecting to the passage inlet 56 is formed at a boundary surface between the first base plate 531 and the second base plate 532. The spray nozzle 534 is fixed onto a surface of the hood 533. The spray nozzle 534 is connected through a connection hose 564 to the passage 563. The connection hose 564 has connectors at both ends, one-side connector 565 being inserted into a through hole 5321 of the second base plate 532 to be connected to the passage 563 and the other-side connector 566 being connected to the spray nozzle 534.

The hood 533 has concave/convex configurations corresponding to the concave/convex configurations on the inside surface of the fixed metal mold 11. The spray nozzles 534 are installed at right angles to the concave/convex surfaces of the hood 533.

The second board portion 52 also has fundamentally the same structure as the first board portion 51. In other words, the second board portion 52 is so constructed that the nozzle cassette 54 is detachably fitted to the board base plate 521 as shown in FIG. 1. Detaching and attaching operations are done by the clamp mechanism 55. The nozzle cassette 54 is composed of a cassette first base plate 541, a cassette second base plate 542, a hood 543 and a large number of spray nozzles 544. Connection structure of the slide tube with the spray nozzles is similar to that of the first board portion 51. The hood 543 consists of one main hood 5431 and two sub hoods 5432, and has the concave/convex configuration corresponding to the concave/convex configuration on the inside surface of the movable metal mold 12.

As shown in FIG. 2, a first mechanical stopper 91 and a first shock absorber 92 are installed and accompanied with the first cylinder mechanism. The first mechanical stopper 91 has a stick shape, one end 911 of which is fixed to the first board portion 51, and the other end of which slidably pierces through the support member 4 and extends at right angles to and in parallel with the support member 4. The first mechanical stopper 91 moves together with the first board portion 51 when the first board portion 51 moves by a specified distance in a direction of arrow A, and an adjusting nut 912 fitted at the other end thus strikes against the support member 4. Thereby, the first mechanical stopper 91 restricts the movement of the first board portion 51 within the foregoing specified distance. The first shock absorber 92 is installed at a side of the fixed metal mold 11 of the first board portion 51. The first shock absorber 92 is so adjusted that its tip end 921 strikes against the fixed metal mold 11 before the tip end of the spray nozzle 534 strikes against the fixed metal mold 11. Thereby, the first shock absorber 92 moderates the shock arising when the first board portion 51 strikes against the fixed metal mold 11. Here, one piece of the first mechanical stopper 91 is installed in the vicinity of the longitudinal central part of the support member 4, and two pieces of the first shock absorbers 92 are installed at longitudinal both sides of the support member 4.

As shown in FIG. 2, a second mechanical stopper 93 and a second shock absorber 94 are installed and accompanied with the second cylinder mechanism. The second mechanical stopper 93 has a stick shape, one end 931 of which is fixed to the second board portion 52, and the other end of which slidably pierces through the support member 4 and extends at right angles to and in parallel with the support member 4. The second mechanical stopper 93 moves together with the second board portion 52 when the second board portion 52 moves by a specified distance in the direction of arrow B, and an adjusting nut 932 fitted at the other end side thus strikes against the support member 4. Thereby, the second mechanical stopper 93 restricts the movement of the second board portion 52 within the foregoing specified distance. The second shock absorber 94 is installed at a side of the movable metal mold 12 of the second board portion 52. The second shock absorber 94 is so adjusted that its tip end 941 strikes against the movable metal mold 12 before the tip end of the spray nozzle 544 strikes against the movable metal mold 12. Thereby, the second shock absorber 94 moderates the shock arising when the second board portion 52 strikes against the movable metal mold 12. Here, one piece of the second mechanical stopper 93 is installed in the vicinity of the longitudinal central part of the support member 4, and two pieces of the second shock absorbers 94 are installed longitudinally at both sides of the support member 4.

Figure 10:
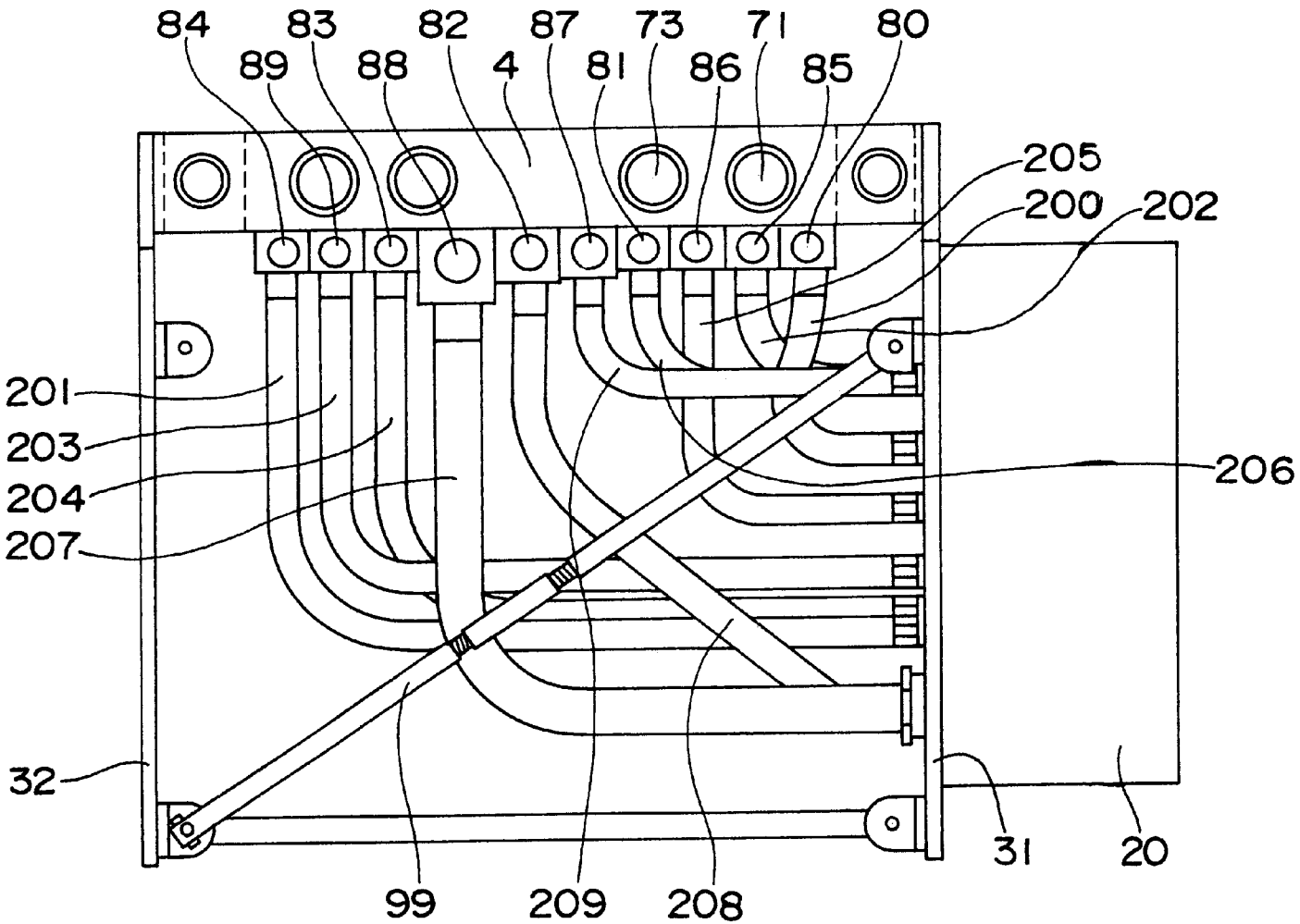
FIG. 10 is a sectional partial view taken on a line X—X of FIG. 2.

FIG. 10 is a sectional partial view taken on the line X—X of FIG. 2, and shows a lower part of the support member 4. As shown in FIG. 10, the supply device 20 is connected to respective slide tubes 80 through 89 by hoses. The first chamber of the distribution manifold of the supply device 20 is connected through a hose 200 to a supply port 805 of the slide tube 80, through a hose 201 to a supply port 845 of the slide tube 84, through a hose 202 to a supply port 855 of the slide tube 85, and through a hose 203 to a supply port 895 of the slide tube 89, respectively. The second chamber is connected through a hose 204 to a supply port 835 of the slide tube 83, and through a hose 205 to a supply port 865 of the slide tube 86, respectively. The third chamber is connected through a hose 206 to a supply port 815 of the slide tube 81, and through a hose 207 to a supply port 885 of the slide tube 88, respectively. The air blow chamber is connected through a hose 208 to a supply port 825 of the slide tube 82, and through a hose 209 to a supply port 875 of the slide tube 87.

As shown in FIG. 10, the two base plates 31 & 32 disposed oppositely are supported by diagonally connected turnbuckles 99. The turnbuckles 99 are provided on all of the diagonal lines.

The function of the spray system having the above-mentioned structure will be described hereunder.

First of all, the moving function of the first board portion 51 will be described.

Figure 11:
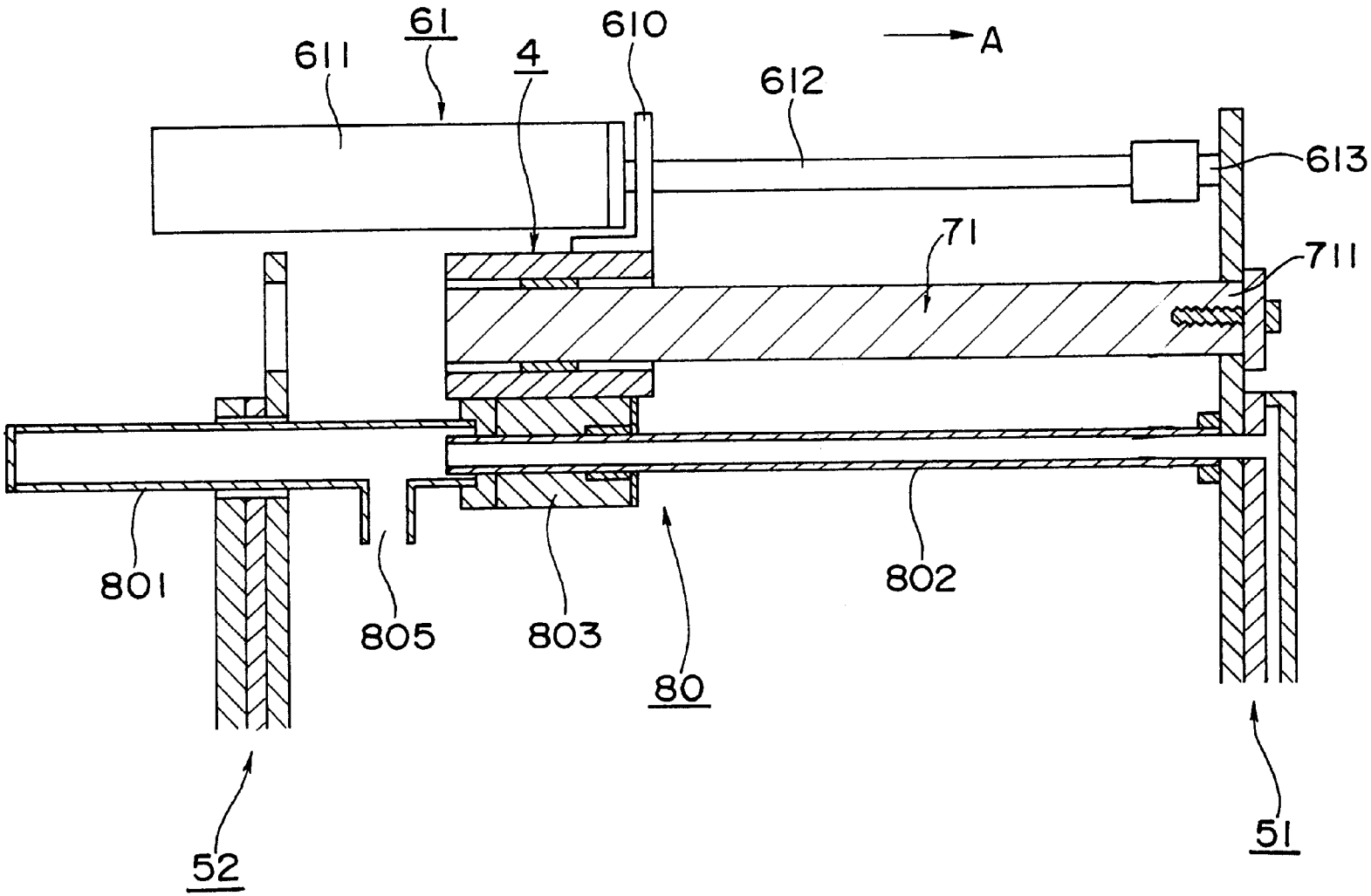
FIG. 11 is a view corresponding to FIG. 5 showing a moving operation of the first board portion.

When the cylinder mechanism 61 of FIG. 5 actuates to cause the rod 612 to move forward in the direction of arrow A together with the cylinder mechanism 62, the first board portion 51 moves in the direction of arrow A accompanied by the holding bar 71 and the internal tube 802 of the slide tube 80 as shown in FIG. 11. The cylinder mechanism 62 actuates in the same way. Since the first board portion 51 is supported to the support member 4 by the cylinder mechanisms 61 & 62, the holding bar 71 etc. and the slide tubes 80 through 84 as mentioned above; it moves while keeping its perpendicular position. After the first board portion 51 has moved by the specified distance, the first mechanical stopper 91 functions so that the movement of the first board portion 51 is securely restricted within the above-mentioned specified distance. Even if the first board portion 51 moves excessively, the shock of striking of the first board portion 51 against the fixed metal mold 11 is moderated and breakage of the spray nozzle 534 due to the striking can be prevented, because the tip end 921 of the first shock absorber 92 strikes against the fixed metal mold 11 before the spray nozzle 534 strikes against the fixed metal mold 11.

The second board portion 52 is also moved in the direction of arrow B by actuation of the cylinder mechanisms 63 & 64 in the same way as the first board portion 51. The cylinder mechanisms 63 & 64 actuate in the same way as the cylinder mechanisms 61 & 62, with the exception of actuation direction.

Figure 12:
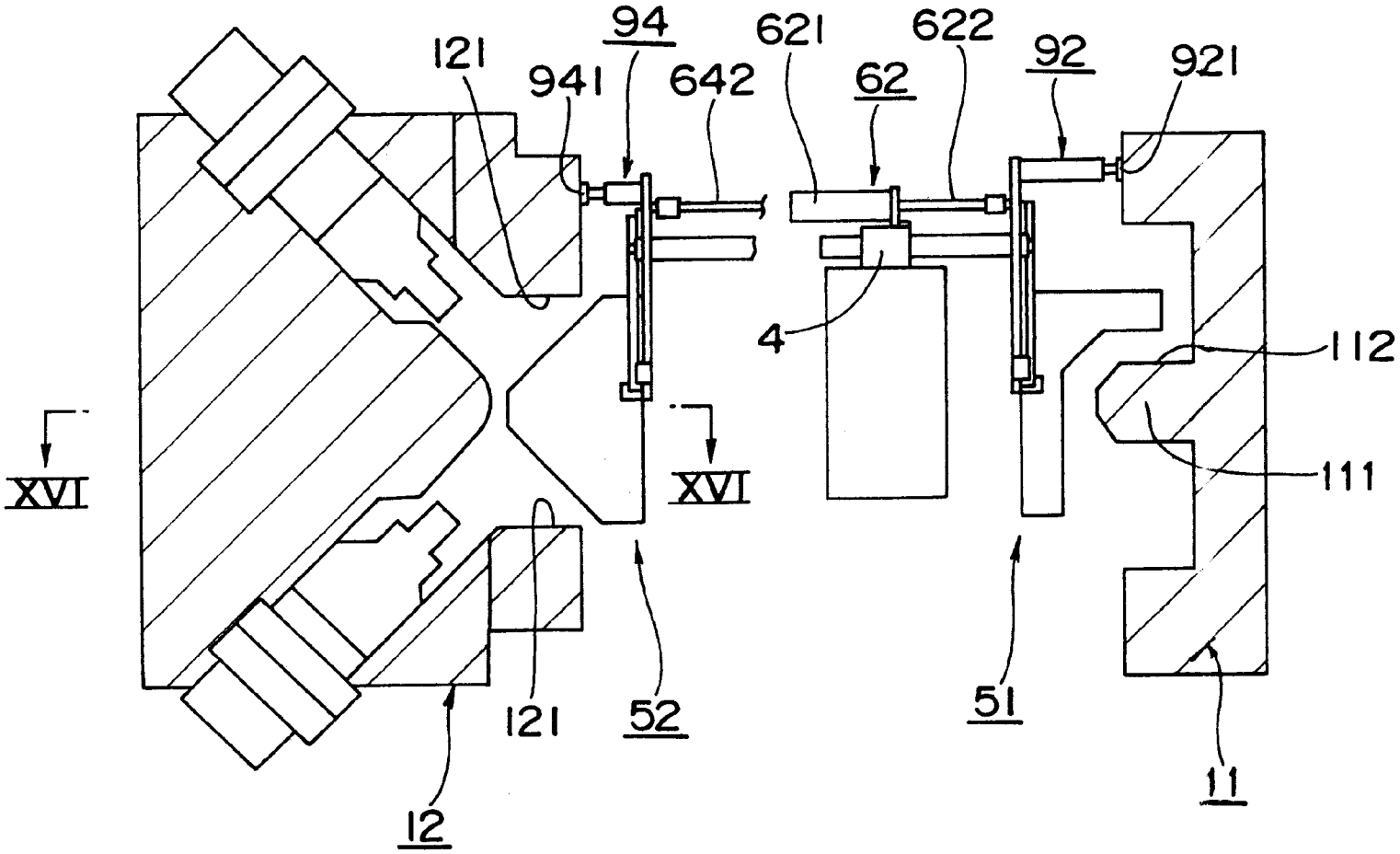
FIG. 12 is a front view showing a state after completion of movement of the both board portions.

FIG. 12 is a front view showing the state where the first board portion 51 and the second board portion 52 have moved. In FIG. 12, the tip end 921 of the first shock absorber 92 is striking against the fixed metal mold 11 and the tip end 941 of the second shock absorber 94 is striking against the movable metal mold 12.

When the supply device 20 actuates under the state of FIG. 12, the mold release agent etc. are sprayed as follows.

(1) The mold release agent mixture is supplied to the first board portion 51 by way of the hoses 200 & 201 and the slide tubes 80 & 84, and sprayed from the spray nozzle 534 located at specified position and connected to the slide tubes 80 & 84 onto the inside surface of the fixed metal mold 11.

(2) The mold release agent mixture is supplied to the second board portion 52 by way of the hoses 202 & 203 and the slide tubes 85 & 89, and sprayed from the spray nozzle 544 located at a specified position and connected to the slide tubes 85 & 89 onto the inside surface of the movable metal mold 12.

(3) The seizure inhibitor mixture is supplied to the first board portion 51 by way of the hose 204 and the slide tube 83, and sprayed from the spray nozzle 534 located at specified position and connected to the slide tubes 83 onto the inside surface of the fixed metal mold 11.

(4) The seizure inhibitor mixture is supplied to the second board portion 52 by way of the hose 205 and the slide tube 86, and sprayed from the spray nozzle 544 located at specified position and connected to the slide tubes 86 onto the inside surface of the movable metal mold 12.

(5) The cool water mixture is supplied to the first board portion 51 by way of the hose 206 and the slide tube 81, and sprayed from the spray nozzle 534 located at a specified position and connected to the slide tubes 81 onto the inside surface of the fixed metal mold 11.

(6) The cool water mixture is supplied to the second board portion 52 by way of the hose 207 and the slide tube 88, and sprayed from the spray nozzle 544 located at specified position and connected to the slide tubes 88 onto the inside surface of the movable metal mold 12.

(7) Air is supplied to the first board portion 51 by way of the hose 208 and the slide tube 82, and sprayed from the spray nozzle 534 located at a specified position and connected to the slide tubes 82 onto the inside surface of the fixed metal mold 11.

(8) Air is supplied to the second board portion 52 by way of the hose 209 and the slide tube 87, and sprayed from the spray nozzle 544 located at a specified position and connected to the slide tubes 87 onto the inside surface of the movable metal mold 12.

After completion of the spray operation as mentioned above, the rods 612 & 622 of the cylinder mechanisms 61 & 62 move backward to cause the first board portion 51 to move to the support member 4 side, and the rods 632 & 642 of the cylinder mechanisms 63 & 64 move backward to cause the second board portion 52 to move to the support member 4 side. Thereby, the spray device 2 is brought into the state of FIG. 1. Then, the spray device 2 is retracted from between the fixed metal mold 11 and the movable metal mold 12, and [the] both metal molds 11 & 12 are closed to commence the die casting work.

According to the spray device 2 having the foregoing structure, the following effects become obtainable.

(1) Since the first board portion 51 and the second board portion 52 are movable, the first board portion 51 can be put near to the inside surface of the fixed metal mold 11 and the second board portion 52 can be put near to the inside surface of the movable metal mold 12 respectively, as shown in FIG. 12. Therefore, the mold release agent etc. can be sprayed onto the inside surface of both metal molds 11 & 12 accurately and securely. For this reason, the occurrence of defective die-cast products can be prevented.

(2) Since the first board portion 51 is so constructed that the nozzle cassette 53 is detachably fitted to the board base plate 511, the replacement of the first board portion 51 can be done by only detaching and attaching the nozzle cassette 53. In addition, the detaching/attaching operation can be done easily by actuating the clamp mechanism 55. Therefore, the replacement of the board portion can be carried out easily and safely. The same effects can be obtained also in the second board portion 52.

(3) Since the hood 533 of the first board portion 51 has a concave/convex configuration corresponding to the concave/convex configuration of inside surface of the fixed metal mold 11 as shown in FIG. 12, the mold release agent etc. can be sprayed securely onto side surfaces 112 of a convex configurations 111 of the fixed metal mold 11. Since the hood 543 of the second board portion 52 has a concave/convex configuration corresponding to the concave/convex configuration of the inside surface of the movable metal mold 12 as shown in FIG. 12, the mold release agent etc. can be sprayed securely even onto side surfaces 121 of the movable metal mold 12. Therefore, the mold release agent etc. can be sprayed thoroughly onto the inside surface of the both metal molds 11 & 12. Consequently, the occurrence of defective die-cast products including seizure etc. cab be prevented more securely.

(4) As shown by FIG. 5, the other end of the holding bar 71 and the other end of the external slide tube 801 of the slide tube 80 slidably pierce and extend through the second board portion 52. Namely, the other end of the first holding bar and the other end of the first slide tube sidably pierce and extend through the second board portion 52. Therefore, as shown in FIG. 13A through FIG. 13D, the moving distance of the first board portion 51 can be made large as compared with a case where the other end side of the first holding bar and the other end of the first slide tube do not pierce and extend through the second board portion 52. Consequently, the spray nozzle 534 can be put nearer to the inside surface of the fixed metal mold 11 so that more accurate spray operation can be done.

Figure 13A:
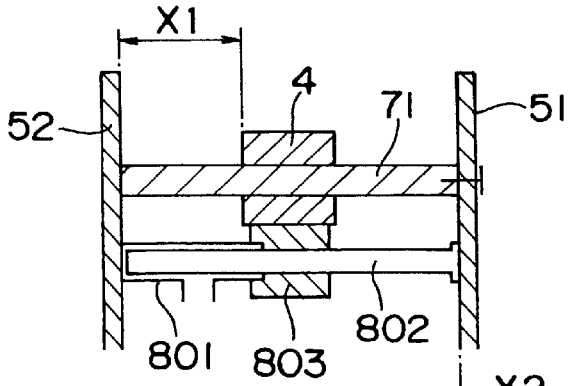
FIGS. 13A through 13D are sectional partial schematic views for explaining merits of the moving mechanism of the first board portion.
Figure 13B:
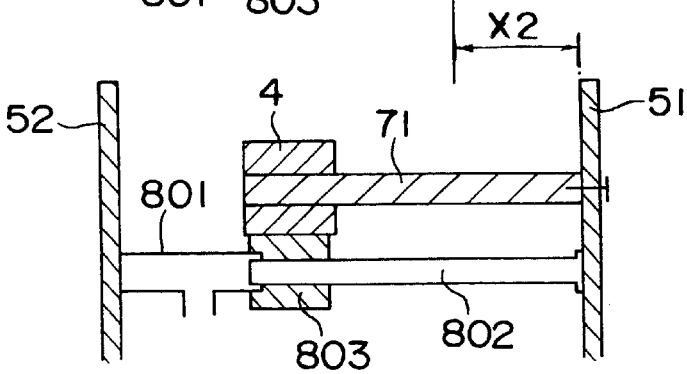
Figure 13C:
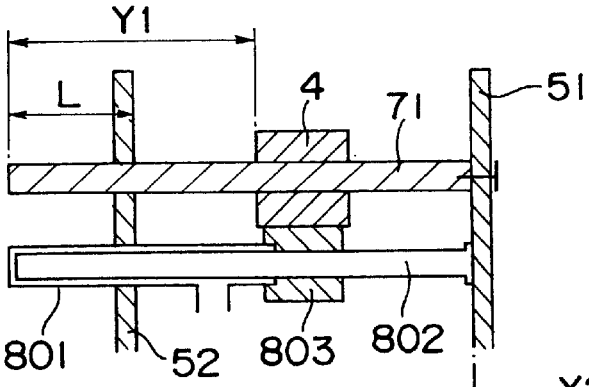
Figure 13D:
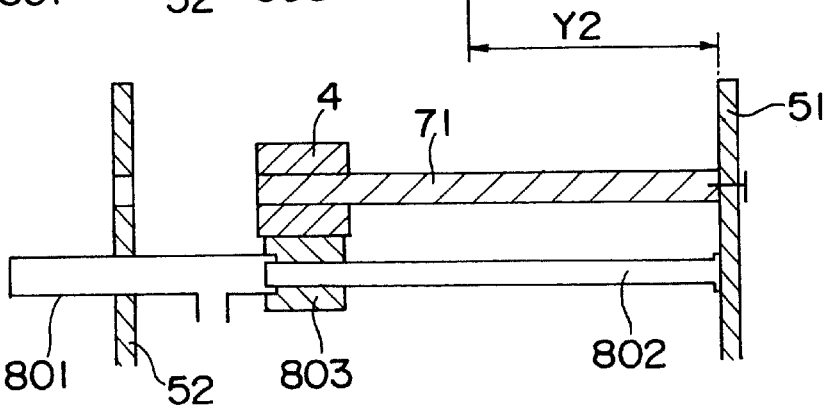

FIG. 13A shows a not-moving state in case where the other end of the holding bar 71 and the other end of the slide tube 80 do not pierce and extend through the second board portion 52, FIG. 13B shows a moving state of the case same as above, FIG. 13C shows a not-moving state in case where the other end of the holding bar 71 and the other end of the slide tube 80 pierce and extend through the second board portion 52, and FIG. 13D shows a moving state in the case same as above. As is obvious by comparing these states, the longest moving distance of the first board portion 51 in case when the piercing is not done is X2 of FIG. 13B corresponding to X1 of FIG. 13A. However, the longest moving distance of the first board portion 51 in case when the piercing is done is Y2 of FIG. 13D corresponding to Y1 of FIG. 13C. Y2 is longer than X2 by a length L that is realized by the holding bar 71 and the slide tube 80 which pierce the second board portion 52.

The longest moving distance of the second board portion 52 is also prolonged in the same way as the case of the first board portion 51. Namely, the other end of the second holding bar (a holding bar 73 etc.) and the other end of the second slide tube (slide tubes 85 through 89) slidably pierce and extend through the first board portion 51, as shown by FIG. 6. Consequently, the moving distance of the second board portion 52 can be made large as compared with the case when the other end of the second holding bar and the other end of the second slide tube do not pierce the first board portion 51, for the same reason as the cases shown by FIG. 13A through FIG. 13D. Therefore, the spray nozzle 544 can be put further near to the inside surface of the movable metal mold 12, so that the spray operation can be done more accurately.

For this reason, in the spray device 2 having the above structure, the mold release agent etc. can be sprayed accurately onto spray points of the inside surfaces of the both metal molds 11 & 12.

(5) Since the first board portion 51 is equipped with the first shock absorber 92, the shock of striking of the first board portion 51 against the fixed metal mold 11 can be moderated and breakage of the spray nozzle 534 due to the striking can be prevented. Since the second board portion 52 is equipped with the second shock absorber 94, the shock of striking of the second board portion 52 against the movable metal mold 12 can be moderated and breakage of the spray nozzle 544 due to the striking can be prevented.

(6) Since the two base plates 31 & 32 are supported by the turnbuckles 99 connected diagonally, the two base plates 31 & 32 can be held firmly in the perpendicular and oppositely-facing positions.

A structure as described below may be employed for the spray device 2 having the above structure.

Figure 14:
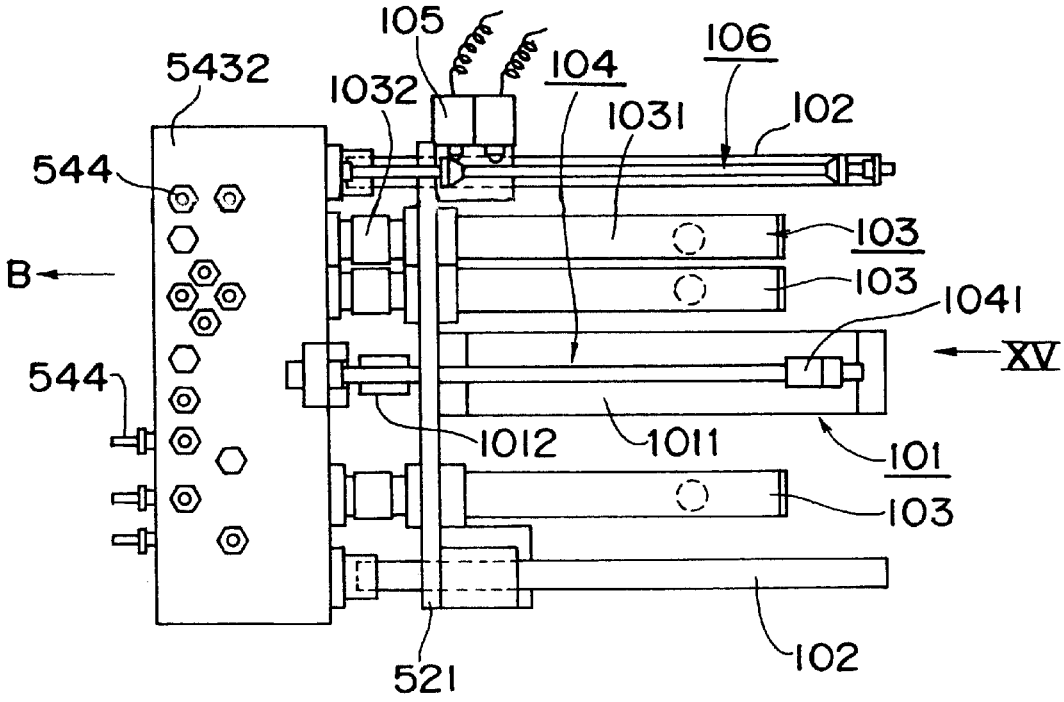
FIG. 14 is a front view showing a working mechanism of sub hood.
Figure 15:
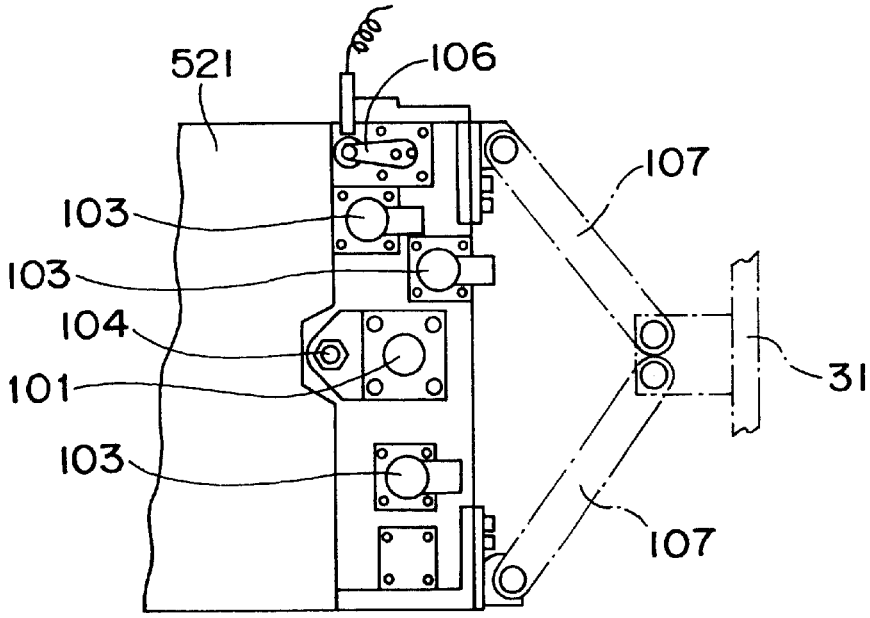
FIG. 15 is a view seen in a direction of XV of FIG. 14.

In the second board portion 52, the sub hood 5432 may be so designed as to actuate independently from the main hood 5431. This working mechanism is approximately similar to the above-mentioned mechanism which moves the board portions 51 & 52. FIG. 14 is the front view showing the working mechanism of the sub hood 5432, and FIG. 15 is the view viewed in the direction of XV of FIG. 14. The sub hood 5432 is supported to the board base plate 521 by means of one cylinder mechanism 101, two holding bars 102 and three slide tubes 103. The cylinder mechanism 101 is fixed to the board base plate 521 at its body 1011, and to the sub hood 5432 at the tip end of its rod 1012. The holding bar 102 slidably pierces the board base plate 521. As for the slide tube 103, its external tube 1031 is fixed to the board base plate 521 and the tip end of the internal tube 1032 is fixed to the sub hood 5432, and the internal tube 1032 is connected to the spray nozzle 544 in the same structure as shown by FIG. 9. The slide tube 103 is connected to the supply device 20 in the same way as the slide tube 80 etc. One end of the mechanical stopper 104 is fixed to the sub hood 5432. The mechanical stopper 104 is so constructed that it moves together with the sub hood 5432 to cause an adjusting nut 104 provided at the other end to strike against the board base plate 521. Thereby, the mechanical stopper 104 restricts the movement of the sub hood 5432 within the specified distance. Here, the cylinder mechanism 101 is controlled by a dog bar 106 equipped with a limit switch 105.

Figure 16:
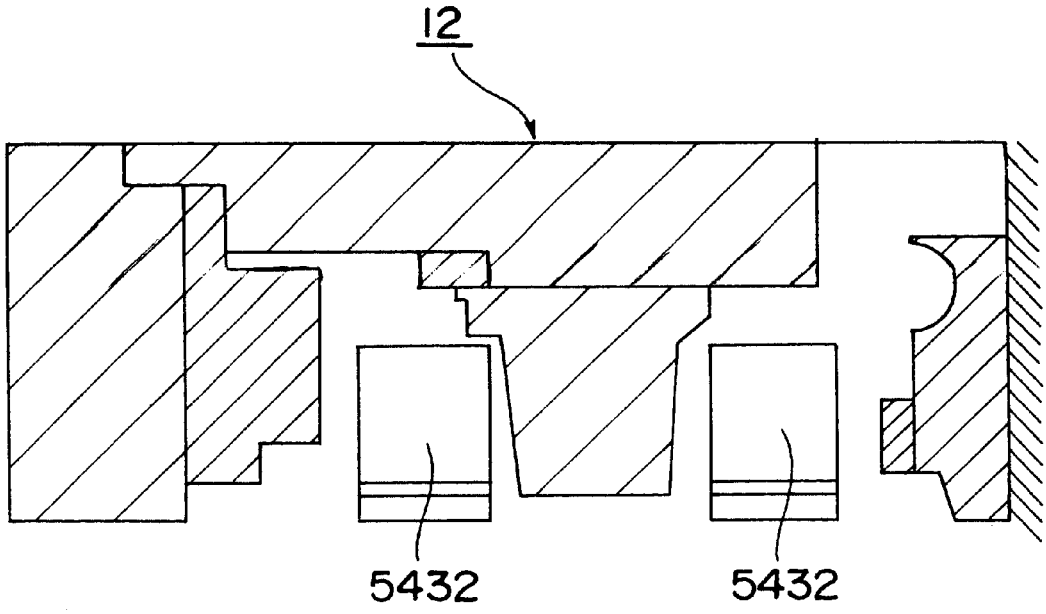
FIG. 16 is a view corresponding to the section taken on a line XVI—XVI of FIG. 12.

In FIG. 14, when the rod 1012 extends in the direction B, the sub hood 5432 moves in the direction of B accompanied by the holding bar 102 and the slide tube 103. When a nut 1061 contacts with the board base plate 521, the sub hood 5432 stops its movement. When the two sub hoods 5432 move in the direction B, the sub hood 5432 goes into a deep portion of the concave configuration of the inside surface of the movable metal mold 12, as shown by FIG. 16 forming the sectional view taken on the line XVI—XVI of FIG. 12. Thereby, the spray nozzle 544 can be put near to the deep portion and more accurate spray operation can be done onto the deep portion.

The board base plate 521 of FIG. 14 may be fixed to the base plate 31 or the base plate 32 by a link arm 107 illustrated by chain lines of FIG. 15, independently and separately from the board base plate 521 provided on the main hood 5431.

The structure using the above sub hood 5432 may be employed for the first board portion 51.

Figure 17:
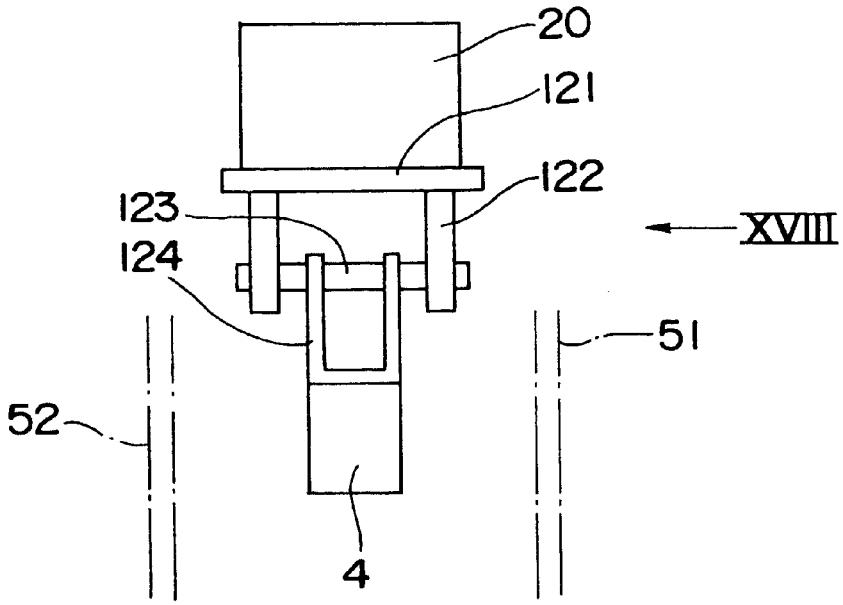
FIG. 17 is a front sectional view of an essential part of the spray system when the base plate is put in a horizontal position.
Figure 18:
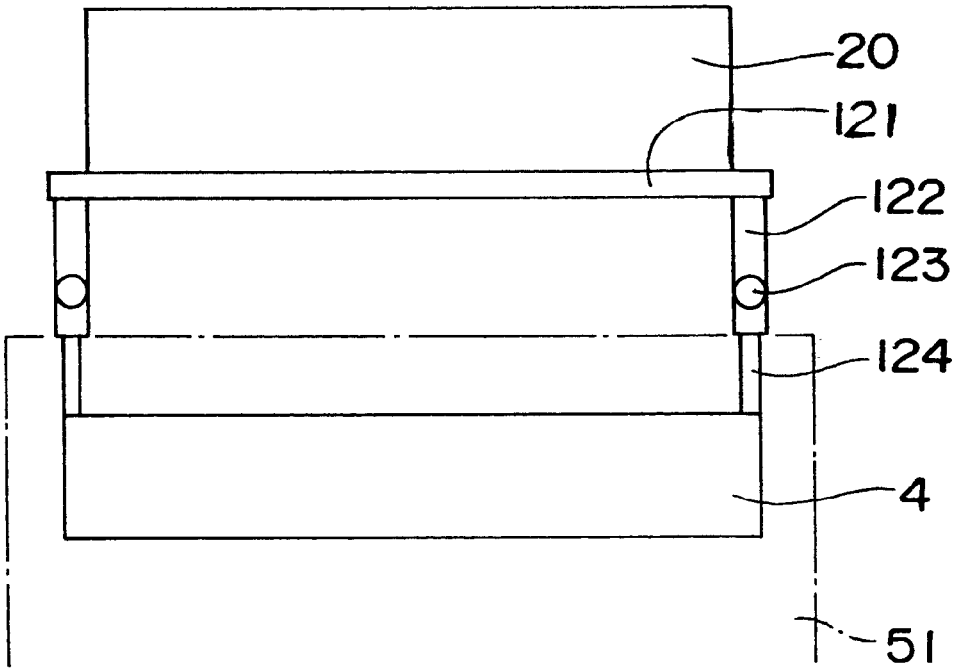
FIG. 18 is a view seen in a direction of XVIII of FIG. 17.

Further, the supply device 20 is fixed to the perpendicular base plate 31 in the spray device 2 having the above-mentioned structure, however, the supply device 20 may be fixed to a horizontal base plate. In this case, as shown by FIG. 17 and FIG. 18 forming the view viewed in the direction of XVIII of FIG. 17 for example, a first arm 122 is extended downward from the base plate 121 and a support bar 123 is fixed to the first arm 122, and a second arm 124 is extended downward from the support bar 123 and the support member 4 is supported by the second arm 124. Then, the cylinder mechanism etc. are fixed to the support member 4 in the same way as the spray device 2 having the above structure.

What is claimed is:

1. A spray system for spraying a mold release agent and other materials onto inside surfaces of opened metal molds for a die canting machine; comprising:

a base plate to which a supply device for distributing and supplying the mold release agent and other materials is mounted, a support member fixed to the base plate, a first cylinder mechanism and a second cylinder mechanism both fixed to the support member, a first slide tube and a second slide tube both fixed to the support member, a first board portion and a second board portion disposed oppositely on both sides of the support member and equipped with spray nozzles for spraying the mold release agent etc., a first holding bar one end of which is fixed to the first board portion and the other end of which slidably pierces and extends through the support member, and a second holding bar one end of which is fixed to the second board portion and the other end side of which slidably pierces and extends through the support member; wherein:

the first slide tube is freely expandable between the support member and the first board portion and connects a supply outlet of the supply device and a passage inlet of the first board portion, the second slide tube is freely expandable between the support member and the second board portion and connects the supply outlet of the supply device and a passage inlet of the second board portion, each board portion is so constructed that a nozzle cassette is detachably fitted to a board base plate, the nozzle cassette is equipped with a large number of spray nozzles, and the spray nozzle is connected to the passage inlet of the board portion, each cylinder mechanism is composed of a cylinder body fixed to the support member and a rod expanding from and retracting in the cylinder body, the first cylinder mechanism is adapted to move the first board portion relative to the support member by expanding and retracting the rod in parallel with the first holding bar, and the second cylinder mechanism is adapted to move the second board portion relative to the support member by expanding and retracting the rod in parallel with the second holding bar.

2. A spray system as set forth in claim 1, wherein the first board portion and the second board portion do not move, in which the other end of the first holding bar also slidably pierces and extends through the second board portion, the first slide tube comprises an external tube and an internal tube expandable from the external tube, the tip end of the internal tube connects to the first board portion, and the external tube pierces and extends through the second board portion.

3. A spray system as set forth in claim 1, wherein the first board portion and the second board portion do not move, in which the other end side of the second holding bar also slidably pierces and extends through the first board portion, the second slide tube comprises an external tube and an internal tube expandable from the external tube, the tip end of the internal tube connects to the second board portion, and the external tube pierces and extends through the first board portion.

4. A spray system as set forth in claim 1, in which the nozzle cassette has concave and convex configurations corresponding to concave and convex configurations on the inside surfaces of the metal mold to be sprayed, and includes a number of spray nozzles on surfaces of the concave/convex configurations.

5. A spray system as set forth in claim 1, in which each board portion is provided with a shock absorber for moderating a shock occurring when the board portion strikes against the metal mold.

6. A spray system as set forth in claim 1, in which two base plates stand at right angles to the board portion and are disposed in such a way as facing each other, the supply device is fixed to the one-side base plate, and the two base plates are supported by diagonally connected turnbuckles.

* * * * *